US007091655B2

(12) United States Patent
Arata

(10) Patent No.: US 7,091,655 B2
(45) Date of Patent: Aug. 15, 2006

(54) CRT VIBRATION DAMPING SYSTEM

(75) Inventor: Enzo Arata, Colleferro (IT)

(73) Assignee: Thomson Licensing, Boulogne-Billancourt (FR)

( * ) Notice: Subject to any disclaimer, the term of this patent is extended or adjusted under 35 U.S.C. 154(b) by 103 days.

(21) Appl. No.: 10/489,001

(22) PCT Filed: Sep. 4, 2002

(86) PCT No.: PCT/EP02/09898

§ 371 (c)(1),
(2), (4) Date: Mar. 5, 2004

(87) PCT Pub. No.: WO03/023811

PCT Pub. Date: Mar. 20, 2003

(65) Prior Publication Data

US 2004/0245907 A1 Dec. 9, 2004

(30) Foreign Application Priority Data

Sep. 7, 2001 (IT) ..... MI2001A1874

(51) Int. Cl.
*H01J 29/80* (2006.01)

(52) U.S. Cl. ..... 313/402; 313/407; 313/408

(58) Field of Classification Search ..... 313/402, 313/407, 408, 269, 348
See application file for complete search history.

(56) References Cited

U.S. PATENT DOCUMENTS

| | | | |
|---|---|---|---|
| 4,827,179 A | 5/1989 | Adler et al. | 313/402 |
| 6,407,490 B1 * | 6/2002 | Shin et al. | 313/403 |

FOREIGN PATENT DOCUMENTS

| | | |
|---|---|---|
| EP | 984482 | 3/2000 |
| EP | 1087418 | 3/2001 |
| EP | 1098349 | 5/2001 |
| JP | 8-077936 | 3/1996 |
| JP | 9-274867 | 10/1997 |

OTHER PUBLICATIONS

Search report dated Nov. 8, 2002.

* cited by examiner

*Primary Examiner*—Vip Patel
(74) *Attorney, Agent, or Firm*—Joseph J. Laks; Harvey D. Fried; Richard LaPeruta, Jr.

(57) ABSTRACT

Color cathode-ray tube comprising a color selection mask tensioned in at least one direction inside a metal frame, the said frame comprising on at least two opposed sides means for damping vibrations of the mask of the type comprising a central part joined to the surface of the frame and two wings extending on each side of the central part and coming into contact with the mask.

7 Claims, 5 Drawing Sheets

CRT VIBRATION DAMPING SYSTEM

Figure 1:
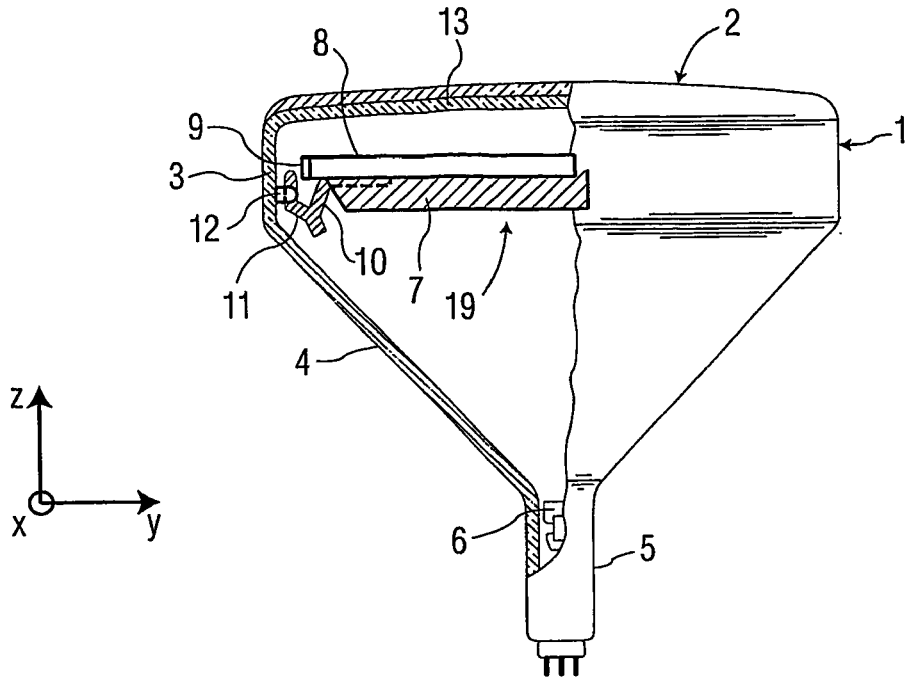

This application claims the benefit, under 35 U.S.C. § 365 of International Application PCT/EP02/09898, filed Sep. 4, 2002, which was published in accordance with PCT Article 21(2) on Mar. 20, 2003 in English and which claims the benefit of Italian patent application No. 01A001874, filed Sep. 7, 2001.

The present invention relates to a masking device for a colour cathode-ray tube. The invention is applicable to any type of tube comprising a colour selection mask and is more particularly suited to tubes whose mask is kept under tension by the frame to which it is secured.

Conventional cathode-ray tubes comprise a colour selection mask located at a precise distance from the inside of the glass faceplate of the tube, on which faceplate arrays of red, green and blue phosphors are deposited in order to form a screen. The mask consists of a metal foil perforated in its central part with a plurality of holes or slots. An electron gun, placed inside the tube, in its rear part, generates three electron beams in the direction of the faceplate. An electromagnetic deflection device, generally placed outside the tube and close to the electron gun, has the function of deflecting the electron beams so that they scan the surface of the panel on which the phosphor arrays are placed. Under the effect of three electron beams, each one corresponding to a particular primary colour, the phosphor arrays enable images to be reproduced on the screen, the mask allowing each particular beam to illuminate only the phosphor of the corresponding colour.

The colour selection mask must be placed and kept in a precise position inside the tube during operation of the tube. The functions of holding the mask are carried out by means of a rectangular metal frame which is generally very rigid, onto which the mask is conventionally welded. The frame/mask assembly is mounted inside the faceplate of the tube by suspension means which are most often welded to the frame and which engage with pins inserted in the glass forming the faceplate of the tube.

The tubes whose faceplate is ever flatter correspond to the current trend, with development towards completely flat faces. In order to produce tubes comprising such a faceplate, there is a technology consisting in using a flat mask, kept under tension in at least one direction. Such structures are described, for example, in U.S. Pat. No. 4,827,179.

Since the colour selection mask consists of a metal foil of very small thickness, tensioning it may generate unwanted phenomena of vibrating the said mask during operation of the tube. Under the effect of shock or of external mechanical vibrations, for example, acoustic vibrations due to the loudspeakers of the television set into which the tube is inserted, the mask may vibrate according to its natural resonant frequency. The consequence of the mask vibrations is to modify the area of impingement of the electron beams on the tube screen, the points of impact of each beam then being offset with respect to the associated phosphor array, thus creating decolouration of the image reproduced on the screen.

U.S. Pat. No. 4,827,179 proposes to add means for damping the mask vibration to one face of the mask. These means are, in a known manner, placed on the peripheral part of the mask not perforated with holes. However, the damping devices implemented in this patent have a complicated structure which is difficult to implement. This is because these devices must be fitted to the surface of the mask once the latter is tensioned on the frame; the fragility of the thin metal foil perforated with holes forming the mask does not allow additional components to be fitted thereto before it is fitted to the frame. However, here again, the fragility of the mask may pose a problem when welding damping means to its surface: any permanent modification to the surface of the mask may cause the complete masking device to be rejected. Moreover, when welding damping elements to the edges of the mask, welding splashes may be produced and may block holes on the central surface of the mask, which would also cause the whole masking device to be rejected.

It is an object of the present invention to provide a cathode-ray tube comprising a masking device for a colour cathode-ray tube comprising simple and cheap damping means which are easy to fit without leading to deterioration of the mask surface. For this, the cathode-ray tube according to the invention comprises:

a colour selection mask in the form of a substantially rectangular metal foil, adapted so that it can be tensioned on a support frame and mounted inside the faceplate of the tube, the said mask comprising a central area pierced with orifices and a peripheral area placed between the central area and the edges of the mask, means for damping the vibrations of the mask the damping means being characterized in that they comprise at least one damper in the form of a flexible metal strip comprising a first part attached to the frame and a second part coming into contact with the peripheral area of the mask so as to rub against the surface of the mask when the latter vibrates.

Figure 2:
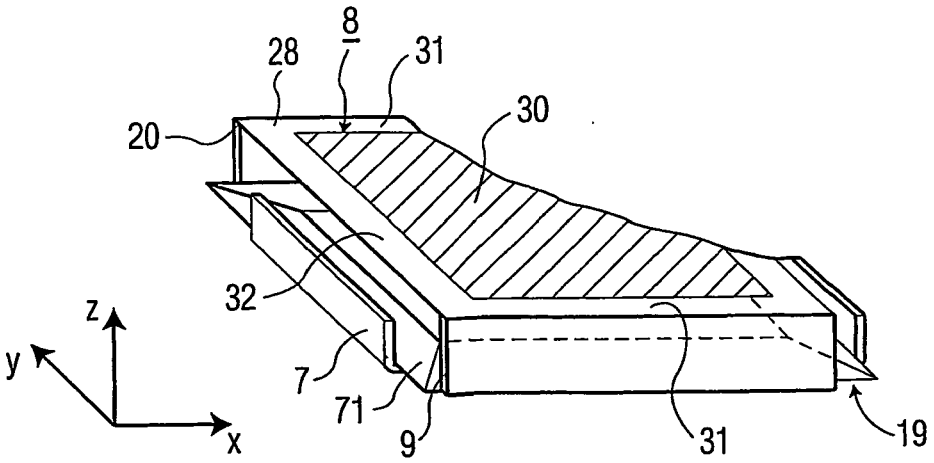
Figure 3:
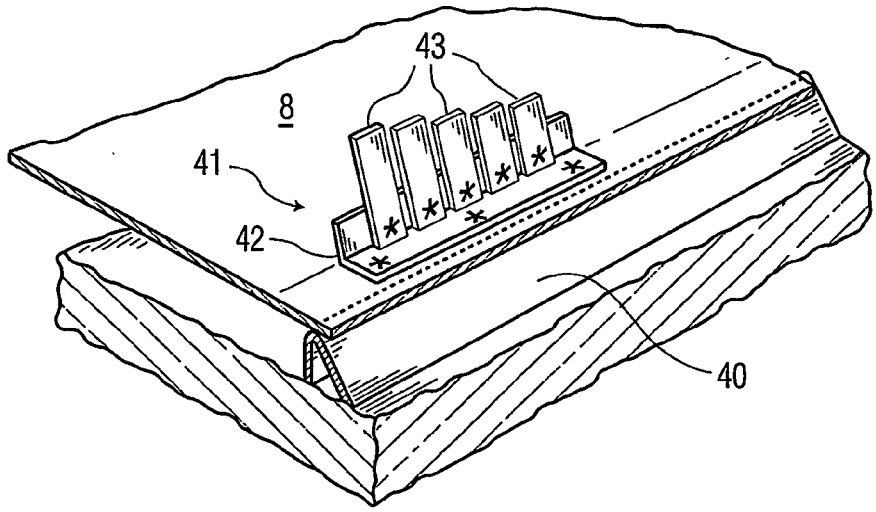
Figure 4:
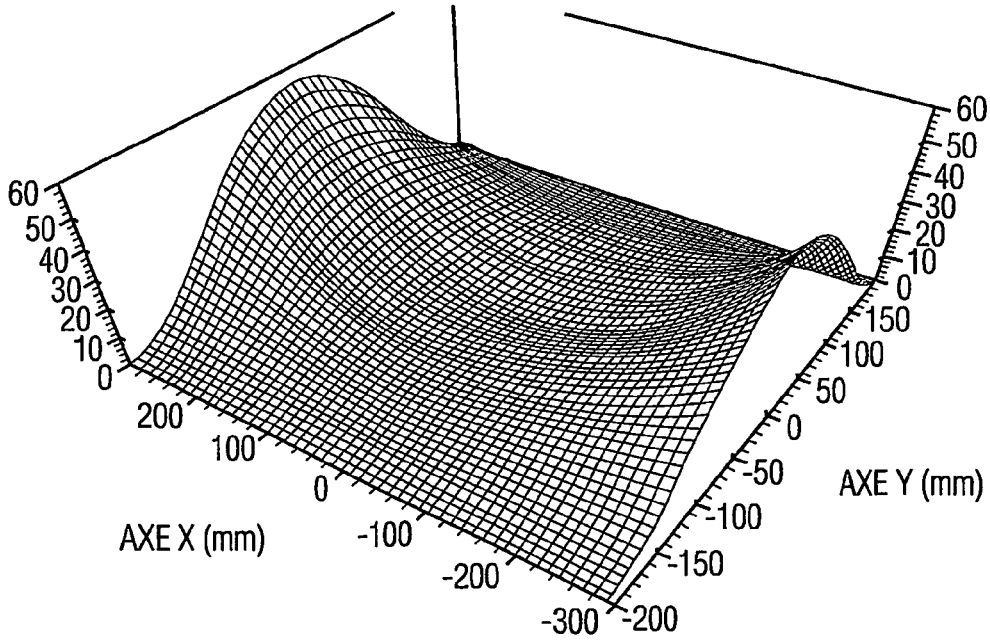

The invention will be better understood with the help of the description below and the drawings among which:

FIG. 1 shows a cathode-ray tube according to the invention seen partially exploded, FIG. 2 describes a frame/mask assembly tensioned according to the prior art without vibration damping, FIG. 3 is a perspective view of one embodiment of a vibration damping device according to the prior art, FIG. 4 illustrates the movement profile of the surface of a tensioned mask subjected to vibrations, and FIGS. 5 to 10 illustrate various embodiments of the invention.

As illustrated in FIG. 1, a cathode-ray tube 1 according to the invention comprises a substantially flat plate 2 and a peripheral skirt 3. The plate is joined to the rear funnel-shaped part 4 of the tube by means of a glass frit seal. The end part of the tube 5 surrounds the electron gun 6, the beams of which illuminate the phosphor screen 13 through the colour selection mask 8, which in this case is flat, for example tensioned between the long sides 9 of the frame 19. Metal supports for the frame/mask assembly hold this assembly inside the tube, the said supports possibly comprising a part 10 welded to the frame and a part forming a spring 11, provided with an aperture in order to engage with a pin 12 included in the glass skirt 3.

In the example of the prior art illustrated in FIG. 2, the frame 19 comprises a pair of long sides 9 and a pair short sides 7, the said long and short sides having, for example, an L-shaped cross section, the short sides 7 having a face 71 substantially parallel to the mask. The mask 8, itself of substantially rectangular shape, is tensioned then kept in this state, for example, by welding to the end 20 of the said long sides of the frame.

The mask consists of a metal foil, for example made of steel or made of Invar, with a very small thickness, of about 100 μm. The mask has a central area 30 perforated with holes generally arranged in columns and a peripheral area 28 surrounding the central area 30, the peripheral area comprising, for example, horizontal edges 31 and vertical edges 32 which are not involved in the colour selection.

Cathode-ray tube structures using tensioned colour selection masks have to face the problem of this mask vibrating in its eigenmodes, when the said mask is excited by external vibrations, for example mechanical shocks to the tube or sound vibrations coming from loudspeakers placed close to the tube. Since these vibrations appear as movements of the mask in a direction perpendicular to its surface, the distance between the holes of the mask and the screen varies locally depending on the amplitude of the vibration of the said mask. The purity of the colours reproduced on the screen is therefore no longer guaranteed, the points of impingement of the beams on the screen being shifted depending on the vibration amplitude and on the area of the mask vibrating; for example vibrations of the edges of the holed part 30 of the mask will be more visible on the screen since this area is traversed by electron beams with angles of incidence of a high value.

Moreover, since the mask is placed inside the tube in which there is a high vacuum, the mask vibrations are damped only very slowly, the energy communicated to the mask having very few means of dissipation, which increases the visibility of the phenomenon on the screen when the tube is operating.

As illustrated in FIG. 3, U.S. Pat. No. 4,827,179 proposes a solution to damp the vibrations of the mask using a device 41 forming a coupled oscillator, by placing a mechanical structure comprising a rigid support 42 to which at least one flexible strip 43 is welded on the edges of the mask 8, close to the area where the mask is welded to the frame 40. The natural resonant frequency of the device 41 is chosen so as to damp the mask vibrations in a particular frequency band.

However, this structure has a certain number of disadvantages:

- it is complex and expensive because of the large number of metal parts used (support and flexible strips)
- energy dissipating elements must be added to the damping structure if the aim is to quickly damp the mask vibrations.

The invention proposes a simple economical structure which is easy to implement in order to damp the vibrations of a mask tensioned in one or two directions.

When the frame/mask device is such that the mask has a holed part 30 with holes in columns joined to each other by metal bridges and that the tension exerted on the mask is uniaxial, for example in the direction of the short sides 32, the long sides being welded to the edges 20 of the long sides 9 of the frame, the behaviour of the vibrating mask is as shown in FIG. 4, namely the amplitude of the mask vibration is maximum at the middle of the short sides 32. For a tube incorporating a mask frame of the type described above, it is therefore advantageous to have available a damper according to the invention so that the vibrations of the vertical edges of the mask are best damped.

Figure 5:
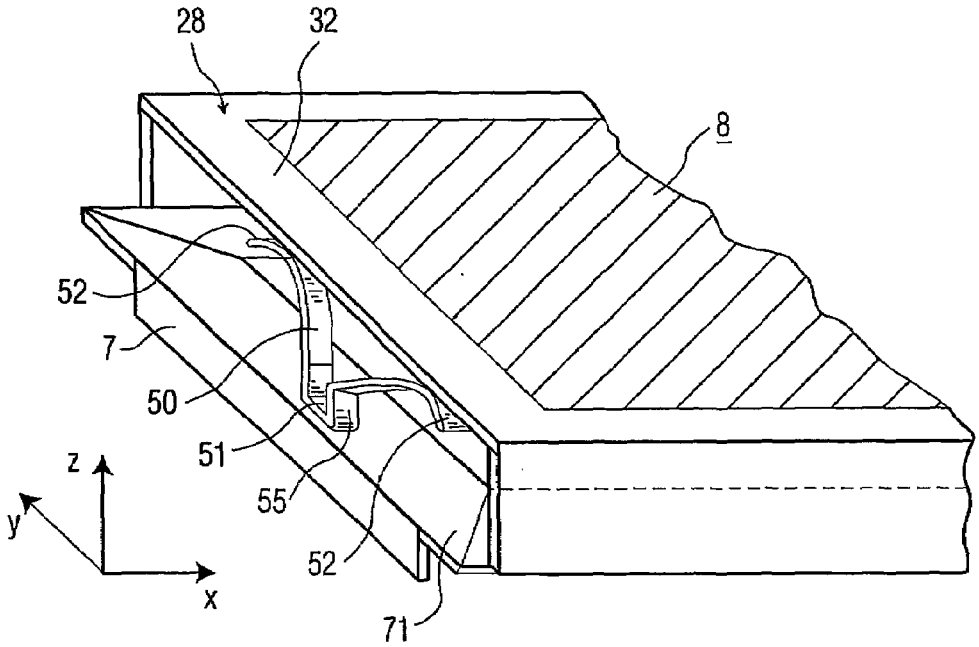
Figure 6:
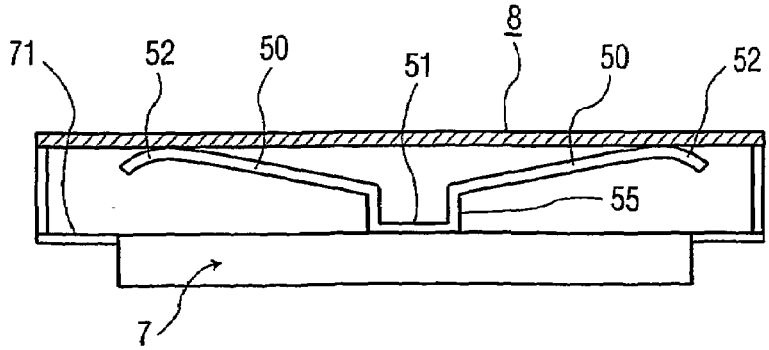
Figure 7:
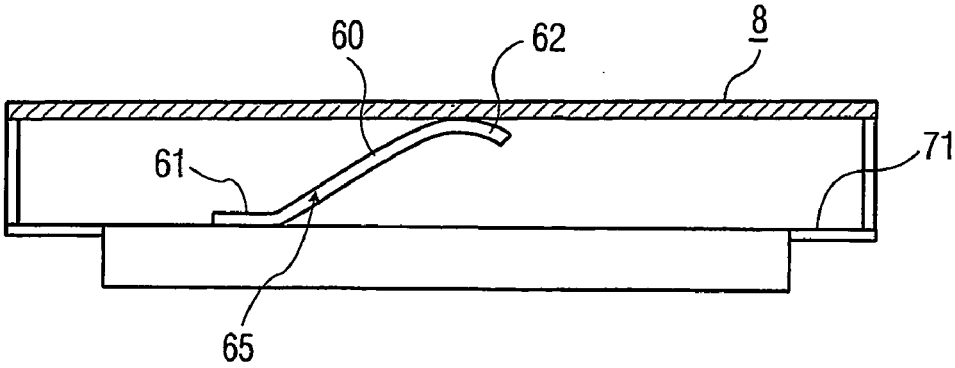

FIG. 5 is a perspective view of a first embodiment of the invention, adapted to a mask tensioned along a single direction, for example parallel to its short sides 32. FIG. 6 illustrates the same embodiment from a side view.

Along the short sides 7 of the frame, on the flange 71 located facing the mask, is located a damping device 55 in the form of a strip, for example made of metal, comprising a part 51 secured to the surface of the frame, for example by welding, and two wings 50 extending on each side of this part 51. The wings 50 come into contact with the peripheral surface of the mask, on which they exert an elastic pressure, at least at rest, on the part 52 of the wings coming into contact with the surface of the mask. The damping device 55 can thus be made in a single piece by cutting and pressing a metal strip or in two identical pieces joined together at the central part 51. The damping device 55 will form, with the mask, a system of coupled dampers; the parameters of the damping device 55, such as the length of the wings 50, their thickness and their weight, are conventionally chosen so as to damp the natural resonant frequency of the mask.

Moreover, the vibration energy of the mask is dissipated by friction between the parts 52 of the damper wing and the surface of the mask against which these parts rub, which contributes to reducing the time in which the mask tends to vibrate.

The location on the peripheral surface of the mask on which the pressure exerted by the damper 55 will be exerted is determined by the vibration modes of the mask which it is desired to damp. It is possible that, for some types of tube, for example small tubes, that is to say with a screen diagonal less than or equal to 65 cm, a pressure exerted on the central part of the periphery 32 of the mask is enough to obtain the desired damping effect. In this case, the damper 65 illustrated by the embodiment of FIG. 7 can advantageously be used. The damper then comprises a single wing 60 welded to the frame at one of its ends 61, the said wing coming via its part 62 into contact with the surface of the mask in the central area of the edge 32.

Depending on the size of the mask to be damped, the materials used, the tension in the mask, the vibration modes to be damped, it could be advantageous to have one or more dampers 55 or 65 on the edge 71 of the frame in order to obtain the desired damping effect.

Figure 8:
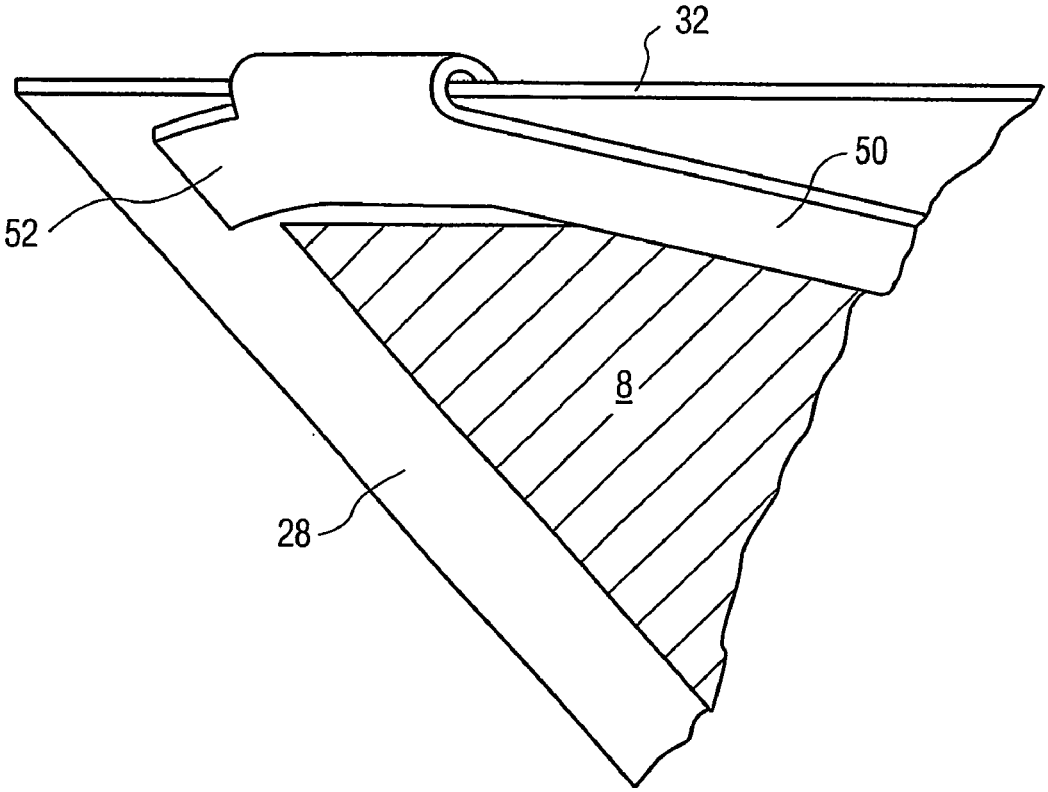
Figure 9:
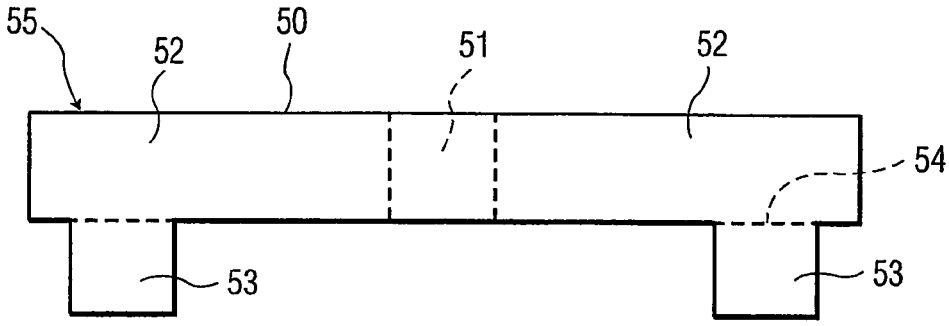

It is possible, if necessary, to improve the coupling between the frame and the mask as illustrated by the embodiment of FIGS. 8 and 9.

FIG. 8 shows, in a perspective view, the detail of the end of the wing 50 according to this other embodiment; the part of the wing coming into contact with the mask furthermore sandwiches the edge 32 of the said mask; FIG. 9 shows a damper 55 in the flat state incorporating this characteristic: the wing 50 comprises an extension 53 at the area 52 of contact with the mask, the said extension, after folding along 54, will cover and contact the surface of the mask opposite the surface contacted by the part 52. In this way, a new mechanical coupling is established along the longitudinal axis Z, between the vibratory movements of the frame and the vibratory movements of the mask; in addition this makes it possible to increase the frictional surface between the said end of the damper wing and the surface of the mask so that the vibration energy of the mask can be dissipated more quickly.

The invention provides a structure enabling the simple implementation of means for dissipating the energy communicated to the mask when the tube is subjected to shock or via powerful sound waves. This is because it is necessary to prevent the vibrations communicated to the mask from lasting too long, even if they are of small amplitude, since they then become visible during operation of the tube. Since the mask is inside the tube in a very high vacuum, it may be necessary to add means for dissipating the energy so that the mask is quickly damped.

Figure 10:
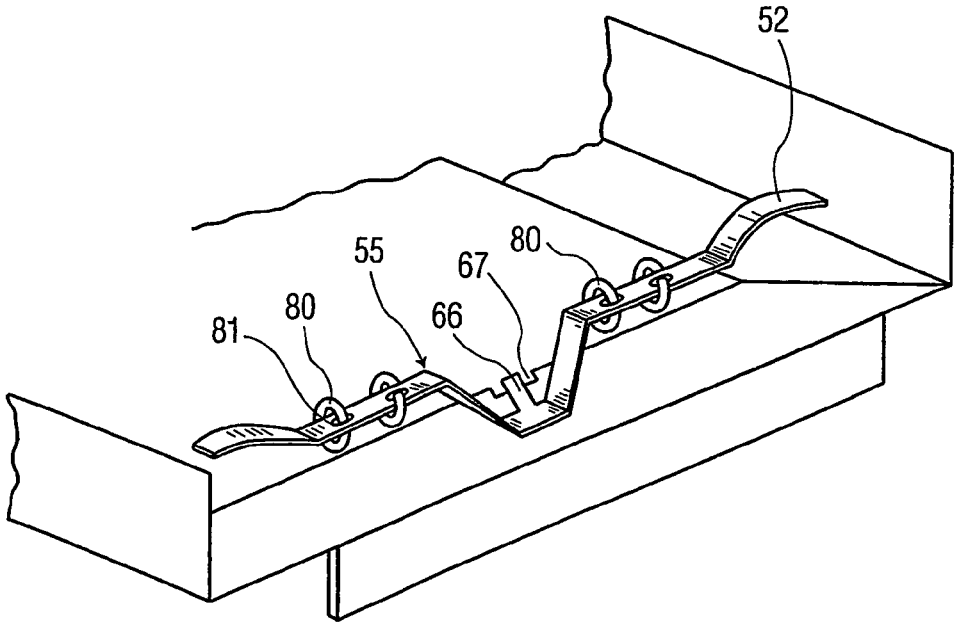

In order to decrease the oscillation time of the mask 8, it is possible, as illustrated by the perspective view of FIG. 10, to add to the wing of a damper 55 at least one metal collar 80 passing through an orifice 81 made in the said wing. The collar may be open or closed, its cross section being slightly less than the diameter of the orifice 81 so that it can move in this orifice and dissipate the energy by friction on the edge of the said orifice.

In another embodiment (not shown), rivets are placed so as to traverse the wings 50 through the orifices 81 made therein, the size of the rivet heads being greater than that of the orifices while the body of the rivet has a cross section slightly less than the diameter of the said orifice.

The arrangement of the dampers 55 along the short sides 7 of the frame is not limiting. For example, where the mask is tensioned in two directions parallel to its length and its width, it is advantageous to arrange the vibration dampers according to the invention along both the horizontal and vertical edges of the said frame.

Means for positioning the damper 55 on the surface of the frame may be added without any complex modification to the structure of the said damper or to the frame itself. The purpose of these means is to facilitate the positioning of the coupled damper on the edge of the frame during the process of manufacturing the tube. As illustrated in FIG. 10, these positioning means may consist of a tongue 66 secured to the damper 55 engaging with a notch 67 located on the edge of the side of the frame.

In another embodiment (not illustrated), the positioning means may consist of a boss intended to be inserted into a suitable opening; the boss may equally be placed on the frame and it then engages with an aperture placed in the central part 51 of the damper, or else the boss is placed on the surface of the damper 55, for example on its central part 51, and it then engages with a hollow placed on the surface of the edge of the frame.

The invention claimed is:

1. Colour cathode-ray tube comprising:

a faceplate, a colour selection mask in the form of a substantially rectangular metal foil, adapted so that it can be tensioned on a support frame and mounted inside the faceplate of the tube, said mask comprising a central area perforated with orifices and a peripheral area placed between the central area and the edges of the mask, said mask being capable of vibrating independently of the support frame, means for damping the vibrations of the mask, the damping means comprising at least one damper in the form of a flexible metal strip comprising a central part attached to a surface of the frame and a second part coming into contact with the peripheral area of the mask so as to rub against the surface of the mask when the latter vibrates, the second part comprising two wings extending on each side of the central part.

2. Cathode-ray tube according to claim 1 wherein the part of the wings coming into contact with the surface of the mask extends on either side of the edge of the mask so as to sandwich it.

3. Cathode-ray tube according to claim 1, wherein the damping means further comprises additional means for dissipating the vibration energy.

4. Cathode-ray tube according to claim 3, wherein the means for dissipating the vibration energy comprises at least one ring passing through the thickness of one wing of the resonator.

5. Cathode-ray tube according to claim 1, wherein the damper and the mask comprise complementary positioning means cooperating in order to ensure the positioning of the damper on the surface of the frame.

6. Cathode-ray tube according to claim 5, wherein the positioning means comprises a boss engaging with an aperture.

7. Cathode-ray tube according to claim 5, wherein the positioning means comprises a tongue engaging with a notch.

* * * * *